US011035058B2

(12) United States Patent
Hightower, III et al.

(10) Patent No.: US 11,035,058 B2
(45) Date of Patent: Jun. 15, 2021

(54) YARN CONTAINING A CORE OF FUNCTIONAL COMPONENTS

(71) Applicant: Inman Mills, Inman, SC (US)

(72) Inventors: William C. Hightower, III, Spartanburg, SC (US); Norman H. Chapman, Spartanburg, SC (US)

(73) Assignee: Inman Mills, Inman, SC (US)

( * ) Notice: Subject to any disclaimer, the term of this patent is extended or adjusted under 35 U.S.C. 154(b) by 143 days.

(21) Appl. No.: 16/101,626

(22) Filed: Aug. 13, 2018

(65) Prior Publication Data

US 2019/0055678 A1 Feb. 21, 2019

Related U.S. Application Data

(60) Provisional application No. 62/546,035, filed on Aug. 16, 2017.

(51) Int. Cl.

| | |
|---|---|
| ***D02G 3/44*** | (2006.01) |
| ***D02G 3/38*** | (2006.01) |
| ***D01H 1/115*** | (2006.01) |
| ***D02G 3/04*** | (2006.01) |
| ***D02G 3/36*** | (2006.01) |

(Continued)

(52) U.S. Cl.

CPC ..... *D02G 3/441* (2013.01); *D01H 1/115* (2013.01); *D02G 3/04* (2013.01); *D02G 3/36* (2013.01); *D02G 3/38* (2013.01); *D03D 1/0035* (2013.01); *D03D 15/47* (2021.01); *D03D 15/513* (2021.01); *D10B 2321/021* (2013.01); *D10B 2321/022* (2013.01); *D10B 2331/02* (2013.01); *D10B 2331/021* (2013.01); *D10B 2331/04* (2013.01); *D10B 2401/16* (2013.01); *D10B 2401/18* (2013.01); *D10B 2401/20* (2013.01)

(58) Field of Classification Search

CPC .. D02G 3/04; D02G 3/36; D02G 3/38; D02G 3/441

See application file for complete search history.

(56) References Cited

U.S. PATENT DOCUMENTS 3,490,224 A * 1/1970 Bourgeas ..... D02G 3/38 57/210
4,154,881 A * 5/1979 Hirakawa ..... D02G 3/36 428/373

(Continued)

FOREIGN PATENT DOCUMENTS

WO WO 2009/037631 A1 3/2009

OTHER PUBLICATIONS https://www.servicethread.com/blog/how-to-estimate-yarn-diameter-and-denier-size : Retrieved Aug. 15, 2020.*

*Primary Examiner* — Shaun R Hurley
(74) *Attorney, Agent, or Firm* — Dority & Manning, P.A.

(57) ABSTRACT

A yarn is produced having a functional core and a covering. The core is either an active functional core having electronic components or passive components and may be monofilament or multifilament. The core and covering are introduced together such that the covering protects the core and gives the core a more comfortable feel such that the yarn may be used in textile applications. The core may be covered by various spinning methods such as air jet or Vortex air jet spinning, ring spinning, open end, or friction spinning. The yarn may also be processed in a single or double covering operation. In one embodiment, the yarn is woven into clothing.

18 Claims, 12 Drawing Sheets

(51) Int. Cl.

| | |
|---|---|
| ***D03D 1/00*** | (2006.01) |
| ***D03D 15/47*** | (2021.01) |
| ***D03D 15/513*** | (2021.01) |

(56) References Cited

U.S. PATENT DOCUMENTS

| | | | | | |
|---|---|---|---|---|---|
| 4,384,449 | A * | 5/1983 | Byrnes, Sr. | A41D 19/01511 | 139/425 R |
| 4,793,130 | A * | 12/1988 | Togashi | D02G 3/12 | 57/210 |
| 4,926,910 | A * | 5/1990 | Wade | D02G 3/12 | 139/425 R |
| 5,617,713 | A * | 4/1997 | Mawick | D02G 3/12 | 57/210 |
| 5,927,060 | A * | 7/1999 | Watson | D02G 3/12 | 337/163 |
| 6,032,450 | A * | 3/2000 | Blum | D02G 3/12 | 57/75 |
| 6,467,251 | B1 * | 10/2002 | Kolmes | D02G 3/185 | 57/230 |
| 7,144,830 | B2 | 12/2006 | Hill et al. | | |
| 7,592,276 | B2 * | 9/2009 | Hill | D02G 3/441 | 442/301 |
| 9,637,843 | B2 * | 5/2017 | Kunisada | D02G 3/441 | |
| 2017/0275789 | A1 * | 9/2017 | Dias | D02G 3/22 | |

* cited by examiner

YARN CONTAINING A CORE OF FUNCTIONAL COMPONENTS

RELATED APPLICATIONS

The present application claims priority to U.S. Provisional Application Ser. No. 62/546,035, filed on Aug. 16, 2017, which is incorporated herein in its entirety by reference thereto.

BACKGROUND OF THE INVENTION

Wearable technology continues to increase in importance in industry and society. The convenience of having technology readily available has become a priority to individuals and businesses. In many fields of endeavor, a desire exists for electronic circuits or other functional components to be incorporated into textiles and into articles that may be made of textiles. As electronic devices decrease in size, textile-based wearable technology has become possible.

A textile is a type of cloth or woven fabric having a network of natural or artificial fibers. Evidence suggests that textile or textile-like materials have been made since prehistoric times. Fibers have historically been wool, cotton, or other material and can be spun together to produce long strands of yarn or thread. Textiles are then formed by weaving, knitting, or other means of interlacing the fibers. Textiles are made in various strengths and degrees of durability and from many materials, including both natural and synthetic materials. Covered yarns, such as single covered yarns obtained by winding a filament yarn or staple fiber around a core, and double covered yarns obtained by further winding around the single covered yarn a second filament yarn or staple fiber, are used in a variety of apparel applications.

Advances in electronics have led to an interest in integrating technology into textiles. Integration of electronics has progressed from placing electrical components on the surface of fabrics or enclosed in pockets to having the components integrated directly into a textile structure during manufacturing. Further, greater benefits can be derived by having electronics integrated into the individual yarns of the textile. However, such yarns may be fairly rigid, stiff, and/or not pleasing to the skin or touch, which can limit their use in clothing. As such, a need exists for a yarn that includes electronic or other functional components without sacrificing the level of comfort of the wearer.

SUMMARY OF THE INVENTION

According to one embodiment of the present invention, a yarn is provided. The yarn includes a core, where the core comprises a functional component; and a covering, where the covering is disposed on at least 50% of a total surface area of the core.

In one embodiment, the functional component can include an integrated active electronic component, an integrated passive electronic component, or a combination thereof. For instance, the functional component can include an electrical conductor, a microprocessor, a computer, an electronic device, an integrated circuit, fiber optics, or a combination thereof.

In another embodiment, the core can include a monofilament yarn.

In still another embodiment, the core can include a multifilament yarn.

In yet another embodiment, the covering can include a staple fiber, a continuous monofilament yarn, a continuous multifilament yarn, or a combination thereof.

In one more embodiment, the yarn can include an insulation disposed between the core and covering. For instance, the insulation can include electrical or thermal insulation and can be impermeable to liquids.

In an additional embodiment, the core can be single covered with a continuous monofilament yarn or a continuous multifilament yarn.

In one embodiment, the core can be double covered with two continuous filament or spun yarns.

In another embodiment, the core can have a diameter ranging from about 0.05 mm to about 0.5 mm.

In still another embodiment, the covering can have a linear mass density ranging from about 50 denier to about 150 denier.

In yet another embodiment, the covering can have a thread wrap count ranging from about 5 thread wraps per inch to about 100 thread wraps per inch.

According to another embodiment of the present invention, a method of forming a yarn is provided, where the yarn comprises a core having a functional component. The method includes placing the core in a spinning process machine; and disposing a covering on the core, wherein the covering is disposed on at least 50% of a total surface area of the core.

In one particular embodiment, the covering can include a staple fiber, a continuous monofilament yarn, a continuous multifilament yarn, or a combination thereof.

In another embodiment, the core can be single covered with a continuous yarn.

In still another embodiment, the core can be double covered with two continuous filament or spun yarns.

In yet another embodiment, the core can be covered by a ring spinning process, an open end spinning process, an air jet spinning process, an air-vortex spinning process, a friction spinning process, a compact spinning process, a covering process, or a combination thereof.

Other features and aspects of the present invention are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DEFINITIONS

Figure 1:
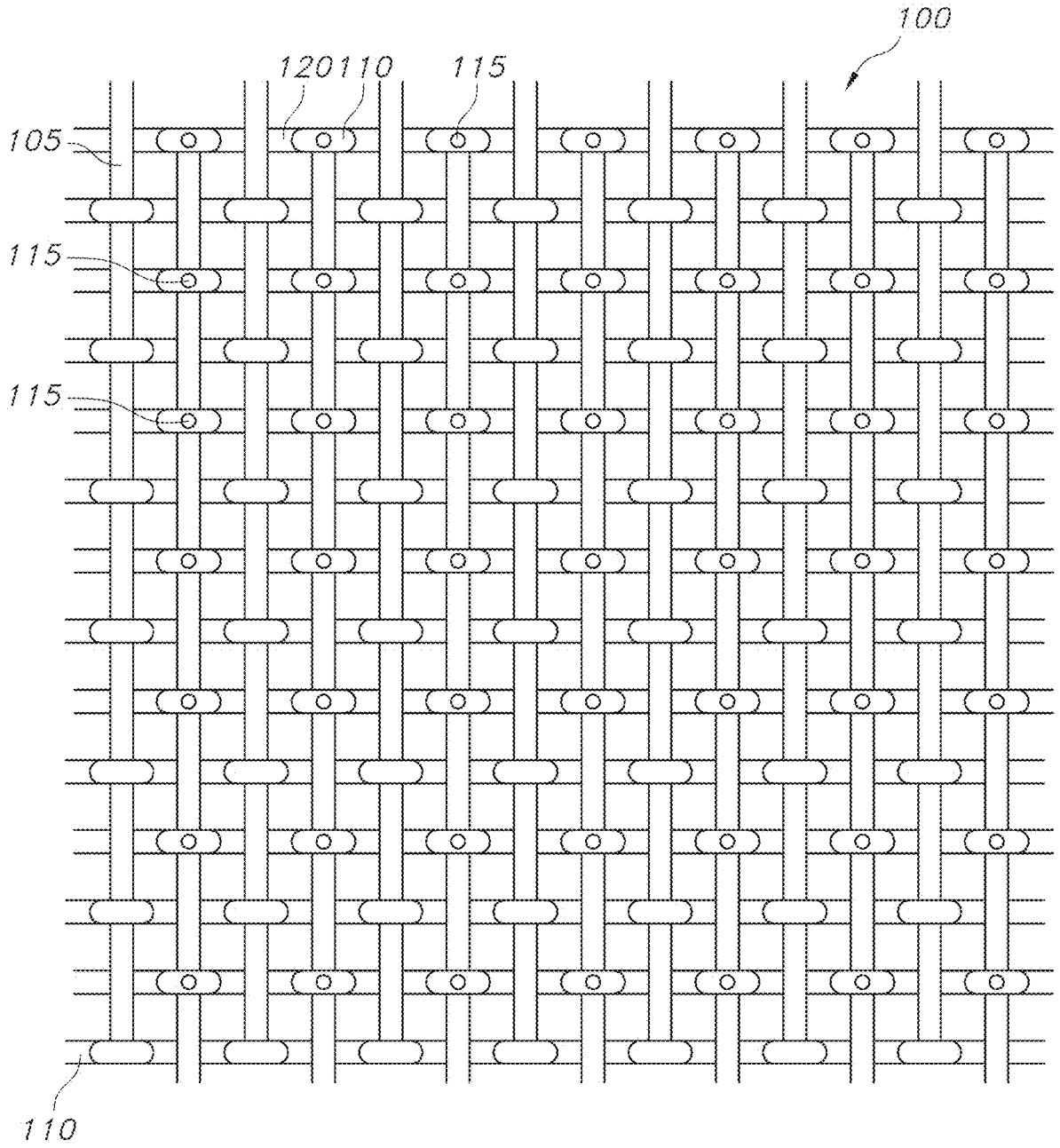
FIG. 1 is an illustration of one embodiment of a textile made in accordance with the present disclosure.

As used herein, "active component" means a device with the ability to produce an electronic signal, energy, or communication to other components.

As used herein, "denier" means the weight per unit length or linear density measurement of a continuous yarn.

As used herein, "passive component" means the component does not introduce energy or communication into a system or circuit.

As used herein, "sliver" means a long bundle of fiber that is untwisted and produced by a carding or combing machine such that the bundle is ready for spinning.

DETAILED DESCRIPTION

Reference now will be made in detail to various embodiments of the invention, one or more examples of which are set forth below. Each example is provided by way of explanation of the invention, not limitation of the invention. In fact, it will be apparent to those skilled in the art that various modifications and variations may be made in the present invention without departing from the scope or spirit of the invention. For instance, features illustrated or described as part of one embodiment, may be used on another embodiment to yield a still further embodiment. For the purposes of this application, like features will be represented by like numbers between the figures.

In general, the present disclosure is directed to a yarn having a core that includes a functional component and a covering, where the covering is disposed on at least 50% of a total surface area of the core. In accordance with the present disclosure, the yarn having a core of functional components is suitable for use in a woven or knitted textile. The textile can then be used in a garment, shoe, bag, packaging, or other product from which a textile is typically formed where the properties of the yarn can be beneficial.

As will be described in greater detail below, the yarn contains a functional core that can contain active or passive electronic components. When the yarn is formed into a textile, technology embedded into the yarn in the form of the active or passive electronic component can provide substantial benefits and conveniences to people and to society as a whole. For instance, a textile formed from yarn with a sensor therein can be used for keyless entry into a locked vehicle, building, room, or compartment designed to open only for a wearer of a particular uniform. Also, the electronics within the core of the yarn can be substantially small such that the textile is flexible and pleasing to the touch, as well as durable enough to withstand degradation from use.

Various textiles may be made in accordance with the present disclosure. The textiles include, for instance, garments including jackets, coats, shirts, uniforms, and pants. In at least one embodiment, the textile may be used in headwear, scarves, gloves, shoes, or belts. In other embodiments, the textile may be used in the interior fabrics of automobiles, planes, ships, or other transportation methods. In yet other embodiments, the textile may be used in luggage, purses, wallets, book coverings, furniture, carpeting, etc. The textiles may be constructed so as to be worn or utilized in all types of environments and settings.

In one particular embodiment, the textile may have multiple discrete functional components that interact with the textile's surroundings. Referring to FIG. 1, one embodiment of a textile 100 constructed in accordance with the present disclosure is illustrated. The fabric or textile 100 includes a yarn 105 that does not contain a core of functional components but is interwoven with a yarn 110 that contains a core of functional components 115, where the yarn 110 can include a covering 120. The yarn 105 that does not contain the core of functional components may be constructed such that the textile has any desired property, as would be known by one having skill in the art. The yarn 110 that contains functional components 115 can be constructed according to methods that will be described in greater detail below, but generally has a core, wherein the core includes the functional component 115; and a covering, wherein the covering is disposed on at least 50% of a total surface area of the core. In the illustrated embodiment, the yarn 110 that has a core of functional components 115 is capable of individually interacting with an external feature. In one embodiment, several functional components 115 together may act as a circuit or network to interact with an external feature. In at least one embodiment, the yarn core can be constructed of a singular functional component that is incorporated into the entire length of the thread. In other embodiments, the core is a network of electronic components, such as microchips, that are connected by a circuit. Thus, the core may be constructed to contain active or passive electronic components.

Figure 2A:
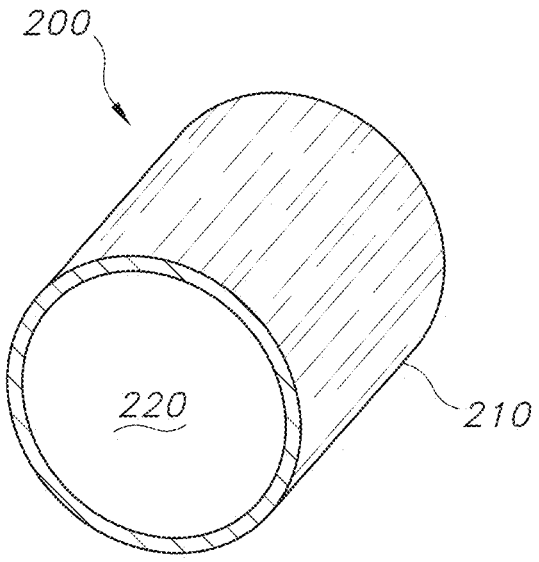
FIG. 2A is a perspective view of an embodiment of a monofilament core.
Figure 2B:
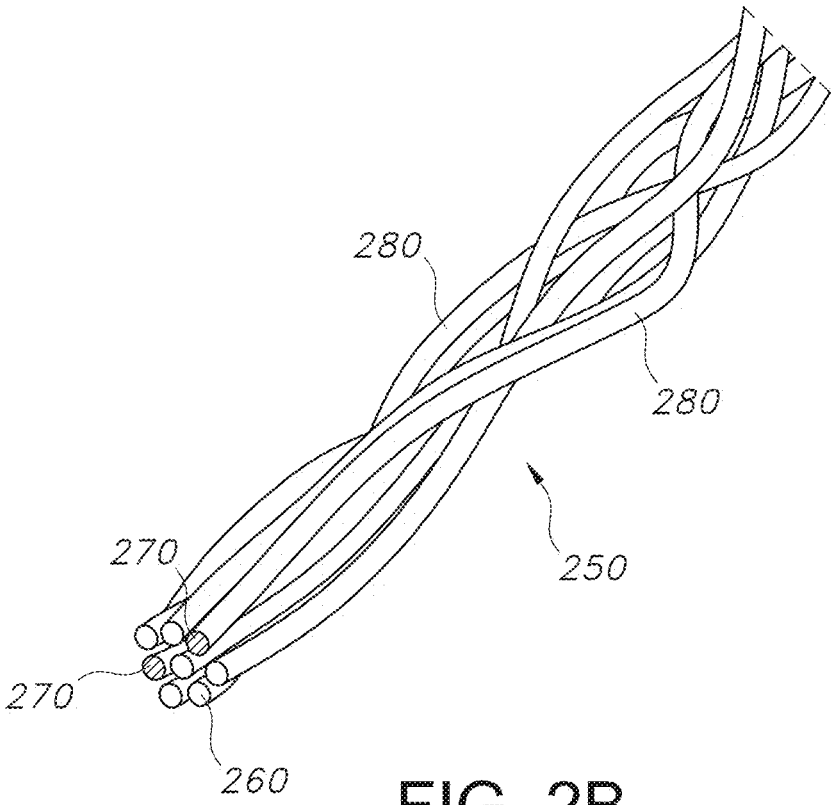
FIG. 2B is a perspective view of an embodiment of a multifilament core.

The construction of a yarn that contains functional components is more particularly illustrated by FIGS. 2A-2B. In FIG. 2A, for instance, the core 200 can be a monofilament. As a monofilament, the core 200 can be made from a single fiber of a material. The material may be a carbon based polymer or plastic and can have a functional component (e.g., an electronic component) embedded therein. The functional components are embedded within the material in a region 220 and may be active or passive in the monofilament embodiment. In one embodiment, the monofilament 200 can contain a layer of insulation 210 to protect the functional components therein and also protect the covering from any portion of the functional component that can potentially cut the fabric, have an electric charge, or generate heat. The monofilament core 200 can have a diameter from about 0.05 millimeters to about 0.5 millimeters. In one embodiment, the core can have a diameter from about 0.075 millimeters to about 0.45 millimeters. In yet another embodiment, the core can have a diameter from about 0.1 millimeters to about 0.4 millimeters. The monofilament core 200 can be constructed of electronic components, conductors, or other functional components, and incorporated in an extrusion process known to one skilled in the art such that the monofilament can include the functional component and polypropylene (PP), (PA) polyamide (nylon), polybutylene terephthalate (PBT), polyethylene terephthalate (PET), polyethylene (PE), polycarbonate (PC), or a combination thereof, although any other suitable materials are also contemplated by the present invention. Further, it is to be understood that the monofilament core 200 can be in the form of a monofilament yarn.

In another embodiment, the core of the yarn of the present invention can be in the form of a multifilament. As shown in FIG. 2B, a multifilament functional core 250 is made up of several smaller filaments 260 that are wrapped together for added strength and flexibility. In some embodiments, each filament 260 of the multifilament core 250 may contain functional components 270. Further, in some embodiments, the multifilament core 250 can include filaments that all have the same function. In other embodiments, the core 250 can include at least one filament 260 that has a functional component 270 and one or more additional filaments 280 that do not have a functional component. In yet another embodiment, the core 250 can be formed from multiple filaments that can include different types of functional components. For example, one of the filaments can include a microcircuit having LED lights, another filament can include a component that provides electric heat for temperature control, and another filament can include a battery for power. The multifilament core can have a total diameter of between about 0.05 millimeters and about 0.5 millimeters. In one embodiment, the multifilament core can have a diameter from about 0.075 millimeters to about 0.45 millimeters. In yet another embodiment, the multifilament core can have a diameter from about 0.1 millimeters to about 0.4 millimeters. Further, each filament can have a diameter of between about 0.01 millimeters and about 0.05 millimeters. In one embodiment, each filament can have a diameter of between about 0.015 millimeters and about 0.04 millimeters. In another embodiment, each filament can have a diameter of between about 0.02 millimeters and 0.03 millimeters. Each filament can be constructed from the functional component and polypropylene (PP), polyamide (PA) (nylon), polybutylene terephthalate (PBT), polyethylene terephthalate (PET), polyethylene (PE), polycarbonate (PC), or a combination thereof, although any other suitable materials are also contemplated by the present invention. Further, the non-functional filaments of the core can be constructed from a multifilament yarn or a monofilament yarn, and the functional components of the core can be contained within a multifilament yarn or a monofilament yarn.

In one embodiment, the core can contain one or more active electronic circuits. For instance, the functional component can include a microprocessor, a computer, an electronic device, an integrated circuit, LEDs, GPS, radio, or a combination thereof. Further, the core can include a network of discreet components such as LEDs or can include a continuous functional component such as an integrated network.

In one embodiment, the core can contain one or more passive electronic components. For instance, one embodiment of a core can include an electrical conductor. Passive components can include fiber optics, metal threads such as copper, silver, or other non-limiting suitable conductors, semi-conductor materials, and other non-limiting components used for data transmission. In other embodiments, the core can include a combination of active and passive electronic components.

In an embodiment where insulation surrounds the core, insulation may be constructed of various suitable materials. In one embodiment, the insulation can include rubber or any polymer or other material that is insulative. In other embodiments, the insulation can be fiberglass, cellulose, or any other material known in the art. In one embodiment, the insulation can be water impermeable. The insulation can have a thickness ranging from about 0.05 millimeters to about 0.1 millimeters. In one embodiment, the insulation can have a thickness ranging from about 0.05 millimeters to about 0.08 millimeters. In yet another embodiment, the insulation can have a thickness ranging from about 0.06 millimeters to about 0.07 millimeters.

Regardless of the particular functional components included in the core, the yarn includes a covering so that the textile can be pleasing to the touch and attractive to a viewer. The covering can be made from various materials. For instance the covering can be made by spinning or wrapping with staple fibers, multifilament yarns, or spun yarns. In one embodiment, the covering can be made of synthetic fibers such as para-aramids, meta-aramids, or other synthetics known in the art. For example, the covering can have flame-resistive properties and be very strong and flexible for application in a fire-fighter's uniform. Other coverings can include moisture resistant yarns.

Figure 11:
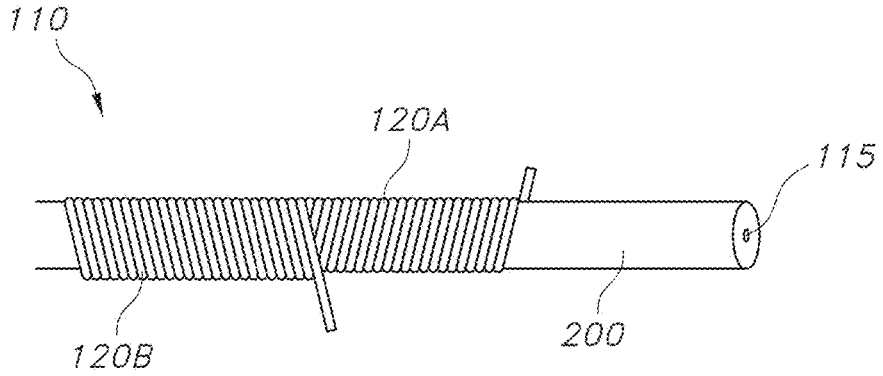
FIG. 11 is a perspective view of a yarn made in accordance with the present disclosure and shows a functional core, a single covering, and a double covering.

The functional core can be covered through various methods. For instance, the functional core can be covered by staple fibers in a spinning process on a ring, open end, air jet, vortex, or friction spinning machinery, or in a covering process. As shown in FIG. 11, in one embodiment, the core 200 with a functional component 115 can be single covered, wherein there is only one layer 120A of covering 120 (e.g., in the form of staple fibers, yarn, etc.) on the core 200. In another embodiment, the core 200 can be double covered, where the core 200 has a first layer 120A and a second layer 120B of covering, where the layers can be in the form of staple fibers, yarn, etc. In yet other embodiments, multiple layers of covering can be added to the core. Further, some core yarns in a textile can be double covered while other core yarns are single covered, and still other core yarns are uncovered. Also, a single core can be covered in some lengths and uncovered in yet other lengths.

In one embodiment, the covering can be disposed on at least 50% of a total surface area of the core. In another embodiment, the covering can be disposed on from about 75% to about 100% of the total surface area of the core. In still another embodiment, the covering can be disposed on from about 90% to about 100% of the total surface area of the core, such as from about 95% to about 100% of the total surface area of the core. In one embodiment, the covering on the functional core can be a monofilament, while in another embodiment, the covering can be a multifilament. In one embodiment, the covering can have a linear mass density ranging from about 20 denier to about 150 denier. In another embodiment, the covering can have a linear mass density ranging from about 40 denier to about 125 denier. In yet another embodiment, the covering can have a linear mass density ranging from about 60 denier to about 100 denier. In one embodiment, the covering can have a thread count of about 5 thread wraps per inch to about 100 thread wraps per inch. In another embodiment, the covering can have a thread count of about 10 thread wraps per inch to about 75 thread wraps per inch such as about 15 thread wraps per inch to about 50 thread wraps per inch.

As mentioned above, the functional core can be covered by the covering in a spinning process on air jet, vortex, ring, open end, friction, or other spinning machinery known to one skilled in the art. Certain functional cores can be resistant to twisting or affected by twist; therefore, the process used to produce the yarn may be considered to insure the functionality of the core is not affected by the covering process.

Figure 5:
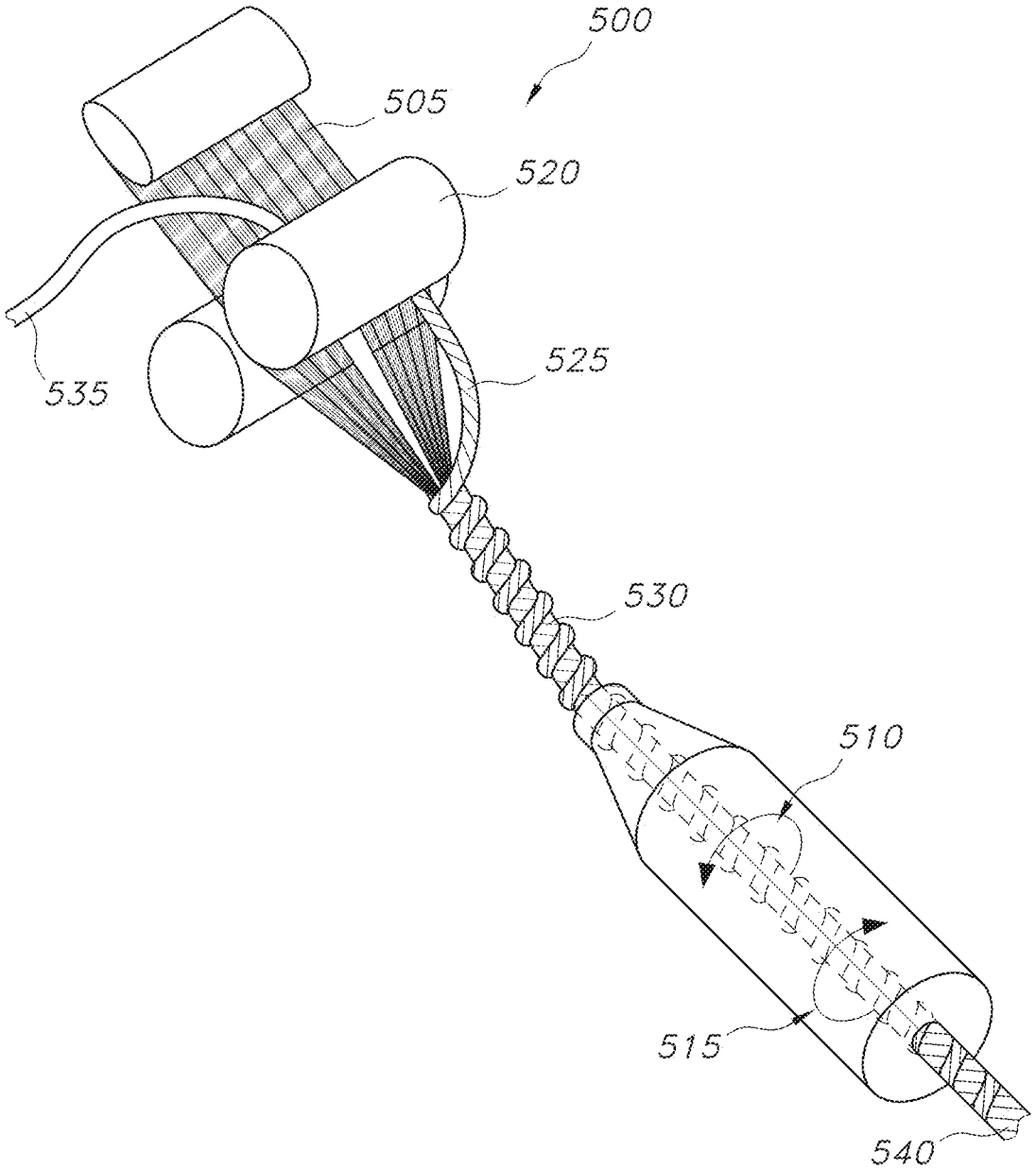
FIG. 5 is an illustration of a method to make a yarn in accordance with the present disclosure utilizing predominantly an air-jet spinning process.

In one embodiment, the covering may be disposed on the core through an air jet spinning process. Referring to FIG. 5, a yarn formed on an air jet spinning machine is shown. Air-jet spinning is a pneumatic process that includes passing fibers 505 through one or two air or fluid nozzles 510 and 515 located between a front roller 520 of a drafting system and a take up device (not shown). The drafting system 500 drafts the input material into a precise form with parallel fibers 505. High pressure air is injected into nozzles 510 and 515, forming swirling air streams in opposite directions. Some covering fibers 525, typically those at the edges of the input material, are not subjected to the full twisting action imparted to the main body of fibers by the downstream air-jet 515 and receive less twist than those fibers in the main bundle. When the yarn gets twisted in the downstream of the nozzle 515, the covering fibers 525 are twisted to a greater degree than the main body of parallel fibers 530. Therefore, they are given a true twist in the direction opposite to that of the upstream twist. The air-jet spun yarn 540 can include an untwisted core of parallel fibers 530 and a surface wrapping of the covering fibers 525. In one embodiment, the functional core 535 can be inserted before the parallel fibers 505 are passed through the front roller 520 and prior to being passed through the nozzles 510 and 515. In one embodiment, the covering fibers 525 may not be uniformly distributed over the length of the air-jet spun yarn 540. However, in other embodiments, the covering fibers 525 can be uniformly distributed about the functional core 535. The frequency and tightness of the covering fibers 525 can be adjusted by one skilled in the art for desired fiber physical properties and spinning process parameters.

Figure 6:
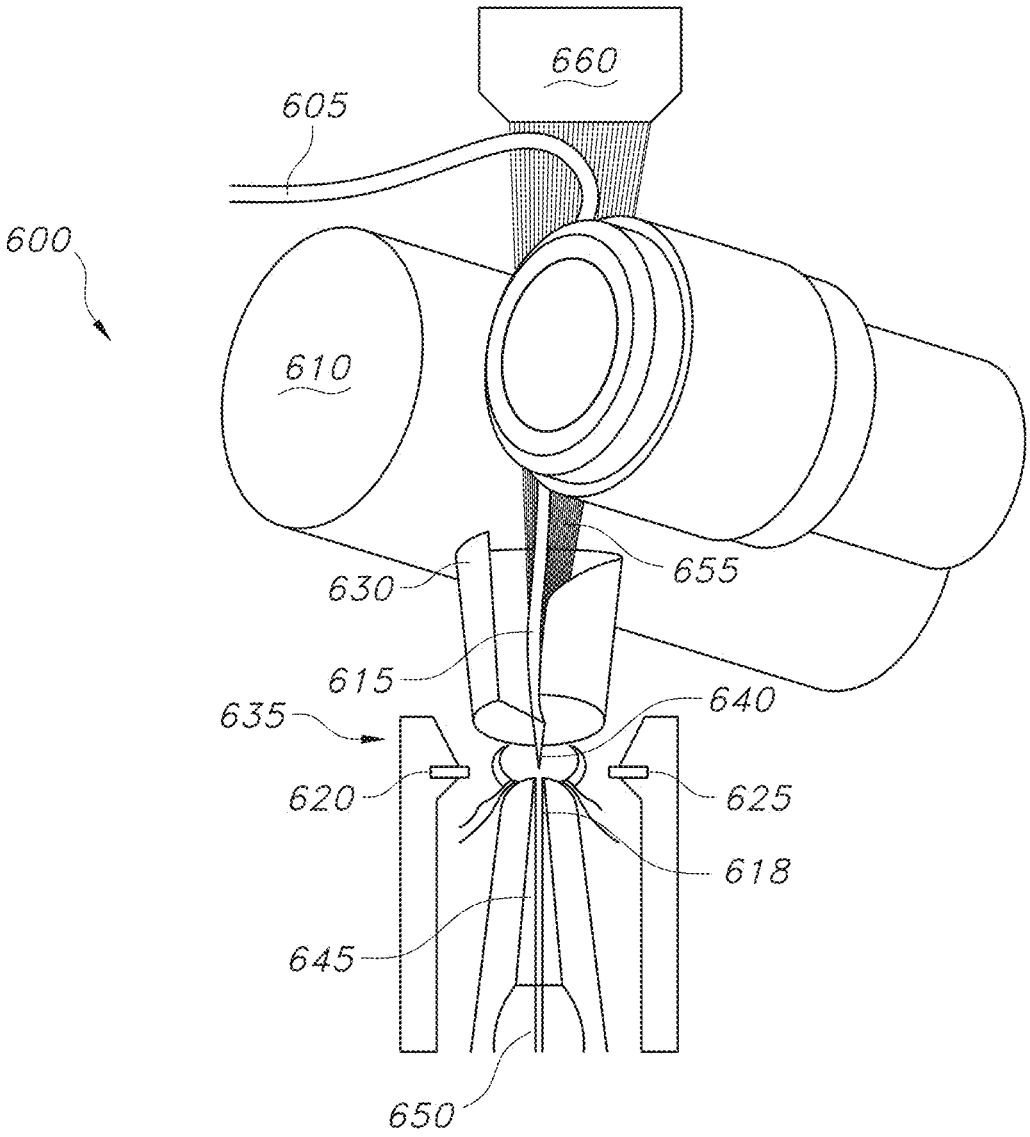
FIG. 6 is an illustration of a method to make a yarn in accordance with the present disclosure utilizing predominantly a Vortex air-jet spinning process.

In another embodiment, as shown in FIG. 6, the covering may be disposed on the core through a vortex air jet spinning machine 600. Vortex spinning provides yarns with different structures and properties than air jet spinning. Similar to the air jet spinning process, the dynamic behavior of the fiber inside the nozzles, which involves fiber-airflow interaction and fiber-wall contact, plays an important role in the yarn making process. In a vortex process, sliver is fed into a drafting unit and when fibers 655 leave a final roller 610 of the drafting device 660, they are drawn into a fiber bundle passage 615 by air suction created by the nozzles 620 and 625. The fiber bundle passage 615 includes a nozzle block 635 and a needle holder 630. An optional guide member 640 protrudes toward the inlet of a spindle 645. The functional core 605 can be inserted before the final roller 610 of the drafting device and is either used in conjunction with the guide member 640 or replaces the guide member 640. The fibers 655 then enter into the hollow spindle 645. After the fibers 655 have left the optional guide member 640, the whirling force of the nozzle 620 separates the ends of fibers 655 from the bundle 618. Since the leading ends of all fibers 655 are moved forward around the guide member and drawn into the spindle 645 by the preceding portion of fiber bundle 618 being formed into a yarn 650, they present partial twist and are less affected by the air flow inside the spindle. When the trailing ends of the fibers 655 which have left the front rollers move to a position where they receive the powerfully whirling force of the nozzle 620, they are separated from the fiber bundle 618, extend outwardly and twine over the spindle 645. Subsequently, these fibers 655 are spirally wound around the core 605 and formed into a vortex spun yarn 650 as they are drawn into the spindle 645. The finished yarn 650 can then be wound on a package after any defects have been removed.

Figure 7:
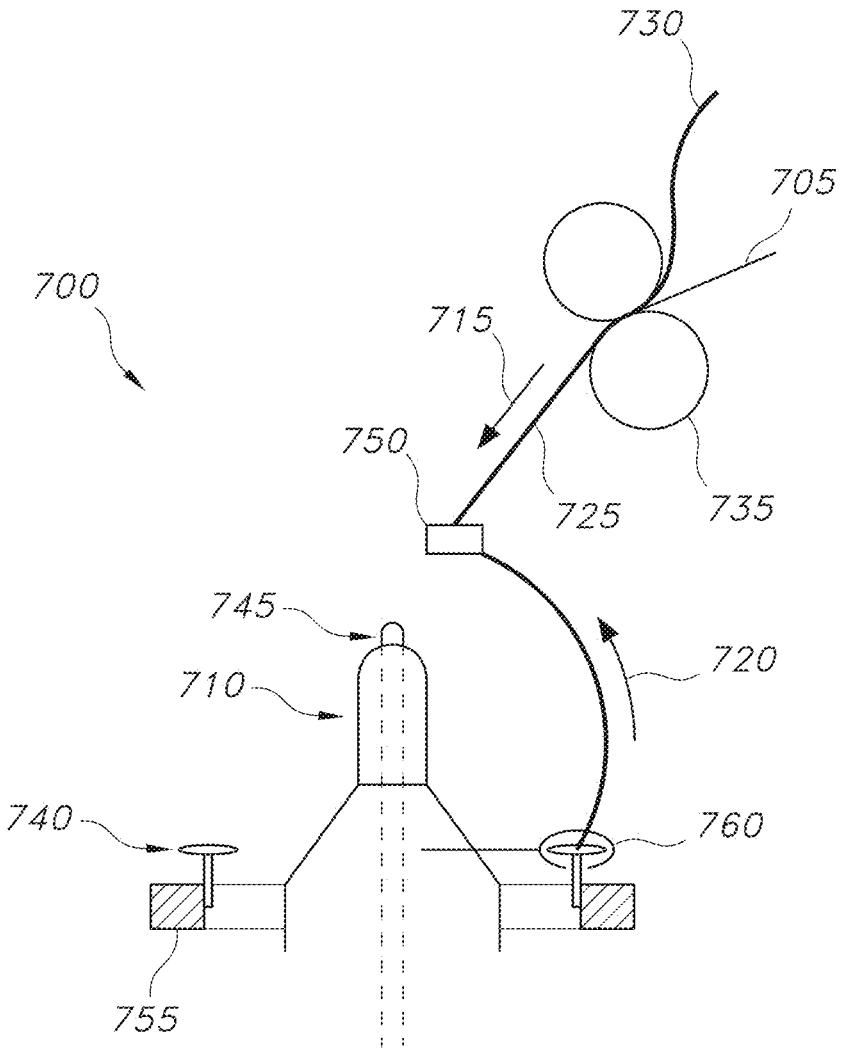
FIG. 7 is an illustration of a method to make a yarn in accordance with the present disclosure utilizing predominantly a ring spinning process.

In one embodiment, the covering can be placed on the core in a ring spinning process via a ring spinning system 700. As shown in FIG. 7, in a ring spinning process, fibrous material is supplied to the ring spinning machine 710 as roving or sliver 705. The roving 705 includes fibers that are lightly twisted or if sliver no twist. The roving 705 is put in a drafting unit prior to the spinning process. The twist inserted by the ring processing moves backwards in a direction 720 in reference to the yarn path 715 and reaches the fibers 725 leaving the drafting unit. The fibers 725 then position around one another in concentric helical paths. The functional core 730 can be inserted into the yarn path before the last drafting roll 735. The roving or sliver 705 can be drawn out until a suitable yarn count is obtained by one skilled in the art, twist is added to the fibers by means of a spindle 745 that rotates, and ultimately the yarn is wound on a yarn package over the spindle 745. The spindle 745, on which the yarn package sits, is responsible for the added twist. A stationary ring 755 is disposed around the ring 740, to which a traveler 760 is attached. The traveler 760 controls the fibers 725 as they are applied to the package and the pigtail 750 controls the fibers 725 centered over the bobbin. The fibers 725 from the drafting unit and the core 730 is drawn into the pigtail 750, and then through the traveler 760 before being led to the yarn package. Ring spinning technology provides the widest range in terms of the yarn counts it can produce.

Figure 8:
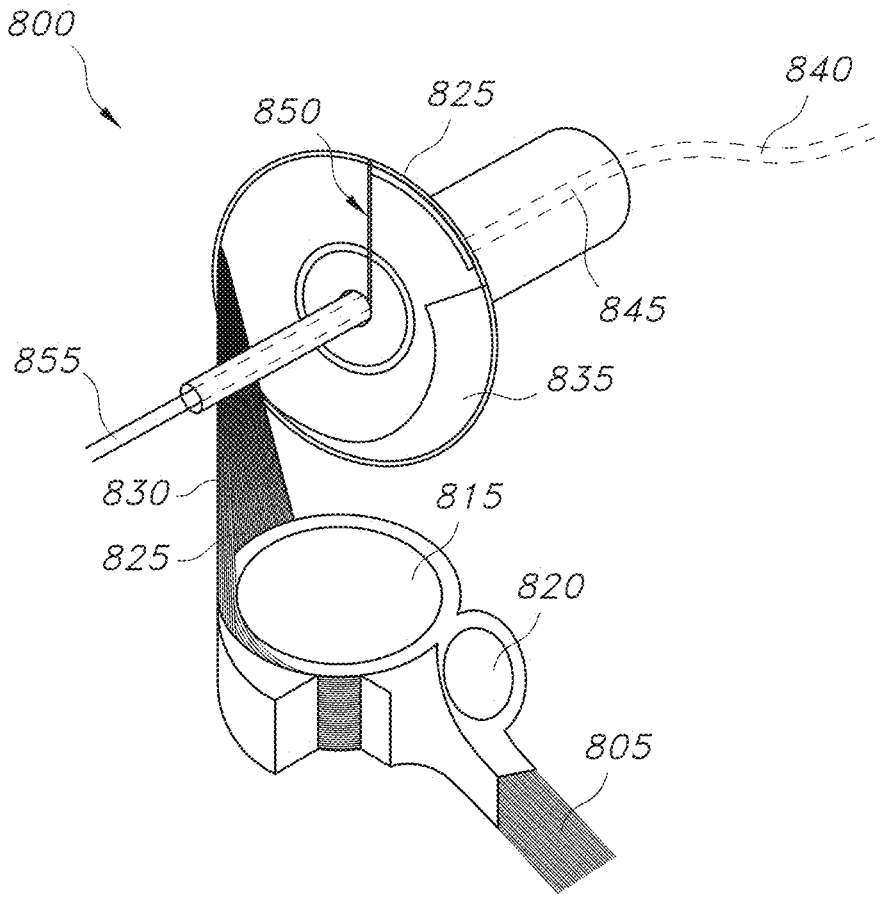
FIG. 8 is an illustration of a method to make a yarn in accordance with the present disclosure utilizing predominantly an open end spinning process.

In another embodiment and referring to FIG. 8, the covering can be placed on the core via an open end spinning machine 800. In open end spinning, sliver 805 is fed into the opening roller 815 by the feed roller 820 and combed and individualized by the opening roller 815. The fibers 825 are sucked down a transportation tube 830 and deposited in the groove of the rotor 835 as a continuous ring of fiber. The fibers 825 are then processed in the rotor 835 where air current and centrifugal force deposits them along the groove of the rotor 835 where they are evenly distributed. The fibers are twisted together by the spinning action of the rotor 835. The core 840 is inserted through a hollow shaft 845 in the center of the rotor 835. The fibers 825 cover the core 840 as the rotor 835 twists the covering 850 onto the core 840. The resulting yarn 855 is then stripped off the rotor 835 and the yarn 855 is continuously drawn from the center of the rotor 835 and collected. The amount of turns in the yarn is determined by the ratio of the rotational speed of the rotor and the linear speed of the yarn.

Figure 9:
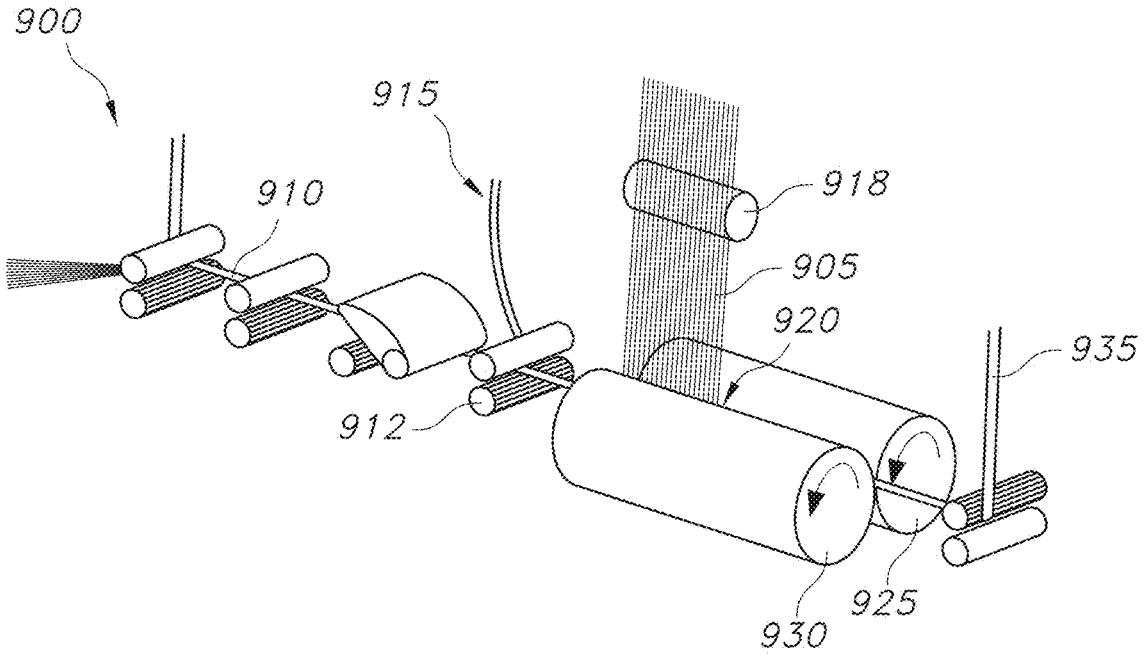
FIG. 9 is an illustration of a method to make a yarn in accordance with the present disclosure utilizing predominantly a friction spinning process.

Referring now to FIG. 9, in still another embodiment, the covering can be placed on the core via a friction spinning system 900. In friction spinning, covering fibers 905 are deposited in a spinning zone 920. A yarn core 910 can be provided by a drafting process. In one embodiment, the core 910 can include a monofilament or a multifilament yarn. Further, the core 910 can include the functional component of the present invention. In yet another embodiment, the yarn core 910 can be provided by a drafting process and the functional component 915 can be inserted before the last drafting roll 912 before being friction wrapped with fibers in the spinning zone 920. In the friction spinning process, the covering fibers 905 are fed directly onto the yarn core 910 from a feed roll 918. The spinning zone 920 (a shear field), is created by two rotating drums 925 and 930 that rotate in the same direction and that are closely adjacent with the core 910 between them. The covering fibers 905 can be deposited onto the core 910 and wrapped over the core in varying helix angles. The rotating drums 925 and 930 twist and compress the covering fibers 905 onto the core 910. The yarn 935 is then continuously removed and collected.

Figure 10:
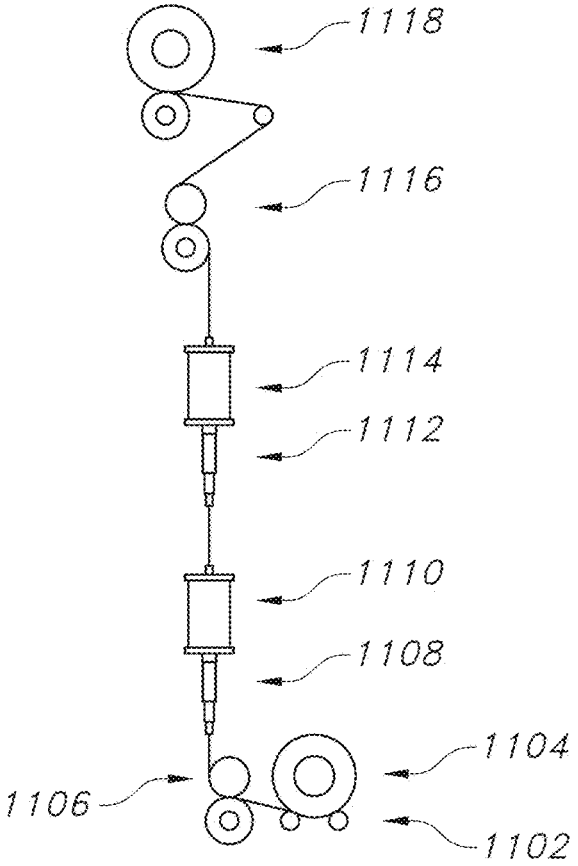
FIG. 10 is an illustration of a method to make a yarn in accordance with the present disclosure utilizing predominantly a covering process.

Turning now to FIG. 10, still another embodiment, a double layer of covering can be placed on the core via a covering process utilizing a covering system. For instance, a feed roller 1102 can feed the core yarn with functional components 1104 through a first spindle 1108 via a roller 1106. The first layer of covering 1110 can be disposed around the core 1104 at the first spindle 1108, whereafter the resulting single-covered yarn is fed through a second spindle 1112 so that the second layer of covering 1114 can be disposed around the now single-covered yarn. Once the second layer of covering 1114 is applied, a delivery roller 1116 and a take up roller 1118 can be used to collect the finished yarn.

The method used to cover the core depends on the resulting texture, strength, and other relevant properties appreciated by one skilled in the art. Certain functional cores may be resistant to twist or affected by twisting so the process used to produce the final yarn must be considered in order to ensure the core function is not affected by the spinning or covering process used.

Various examples of covered yarns and textiles are shown in FIGS. 3A-3D, 4, 12A, and 12B, each of which are discussed in more detail below.

Figure 3A:
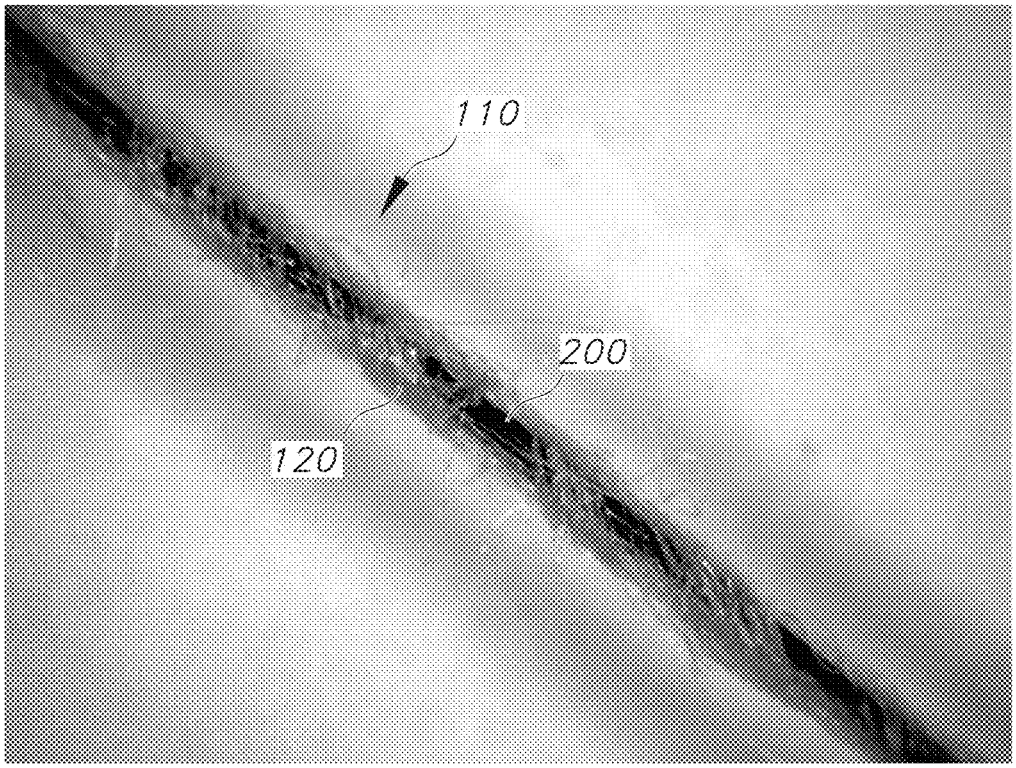
FIG. 3A is an image of a yarn made in accordance with the present disclosure.

FIG. 3A is an image of a yarn 110 with a functional component, where the functional component is contained within a 0.16 mm diameter monofilament core 200 having a covering 120, where the covering is in the form of staple fibers applied via a vortex air jet spinning machine.

Figure 3B:
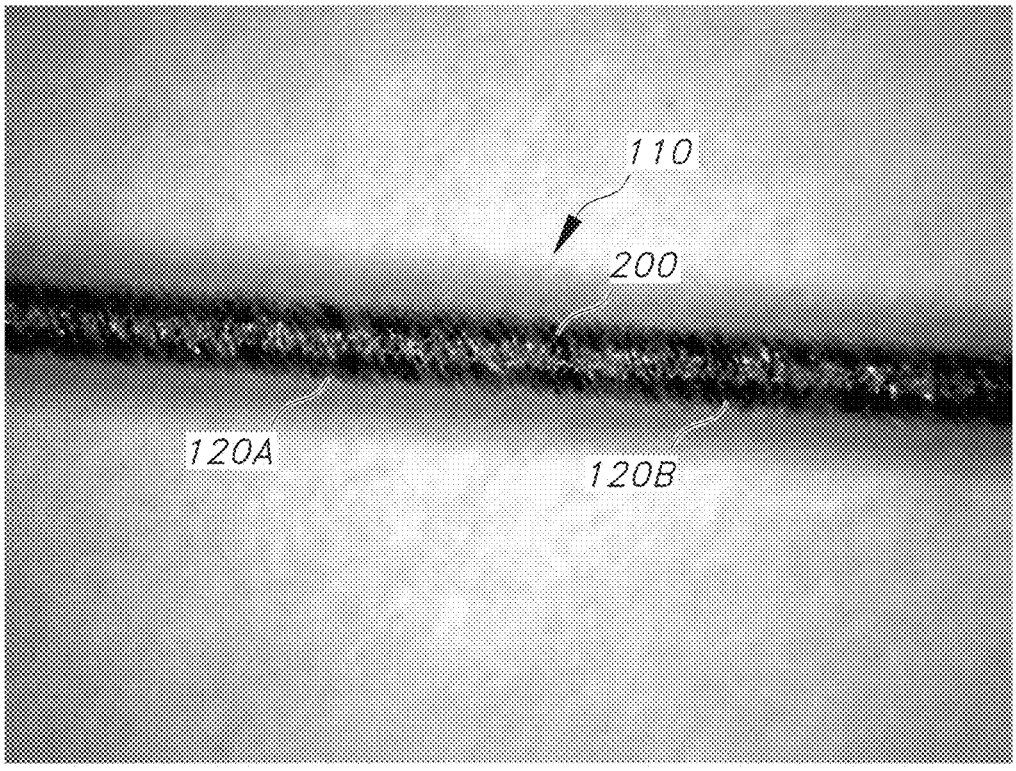
FIG. 3B is an image of a yarn made in accordance with the present disclosure.

FIG. 3B is an image of a yarn 110 with a functional component, where the functional component is contained within a 0.37 mm diameter monofilament core 200 which is double covered with a 70 denier continuous multi-filament, as represented by a first cover layer 120A and a second cover layer 120B.

Figure 3C:
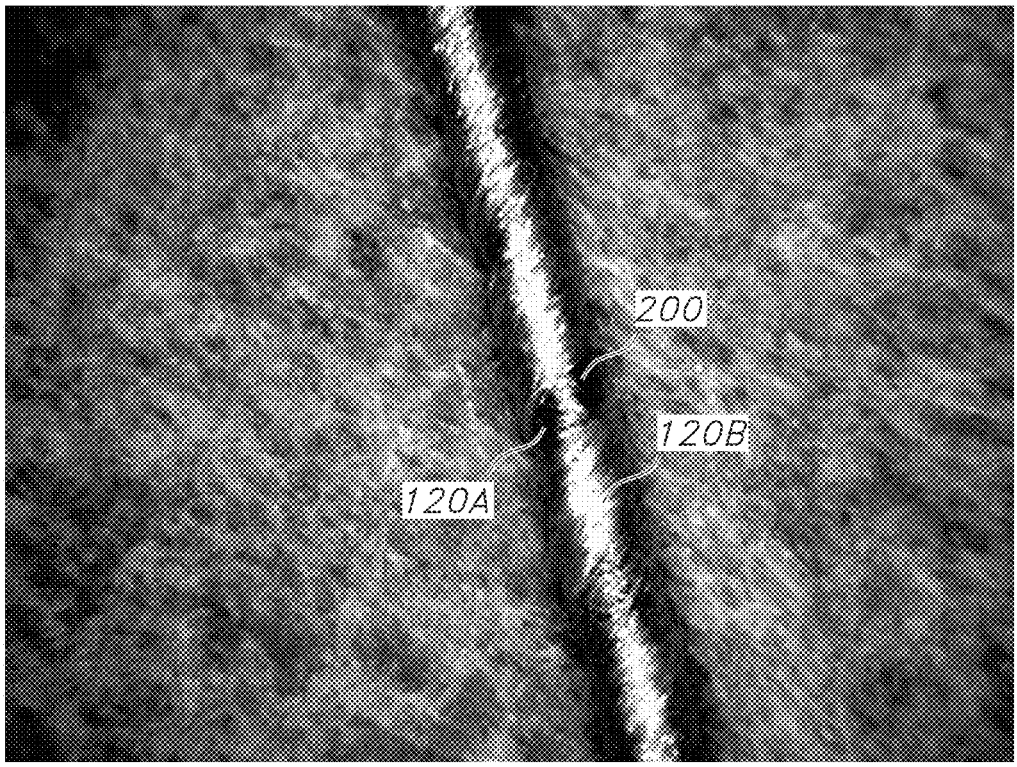
FIG. 3C is an image of a yarn made in accordance with the present disclosure.

FIG. 3C is an image of a yarn 110 with a functional component, where the functional component is contained within a 0.37 mm diameter monofilament core 200 which is double covered with a 150 denier/100 filament per cross section continuous multifilament at 30 turns per inch, as represented by a first cover layer 120A and a second cover layer 120B.

Figure 3D:
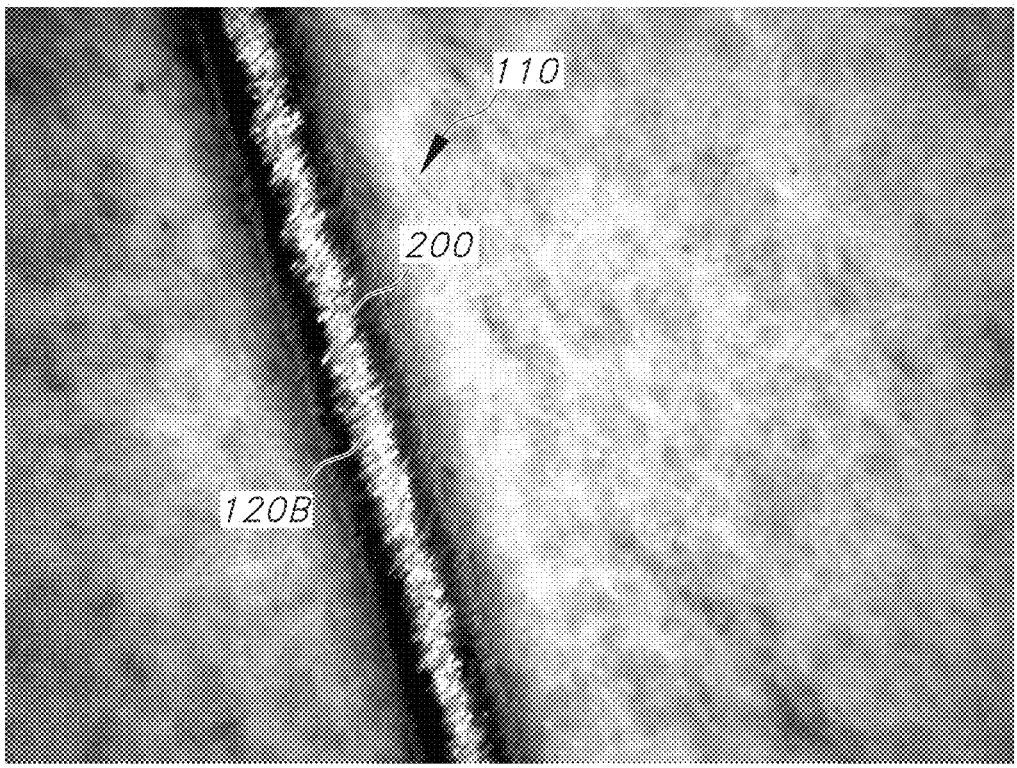
FIG. 3D is an image of a yarn made in accordance with the present disclosure.

FIG. 3D is an image of a yarn 110 with a functional component, where the functional component is contained within a 0.37 mm monofilament core 200 which is double covered with a 150 denier/100 filament per cross section continuous multifilament at 40 turns per inch, where the first cover layer (not shown) is completely covered by the second cover layer 120B.

Figure 4:
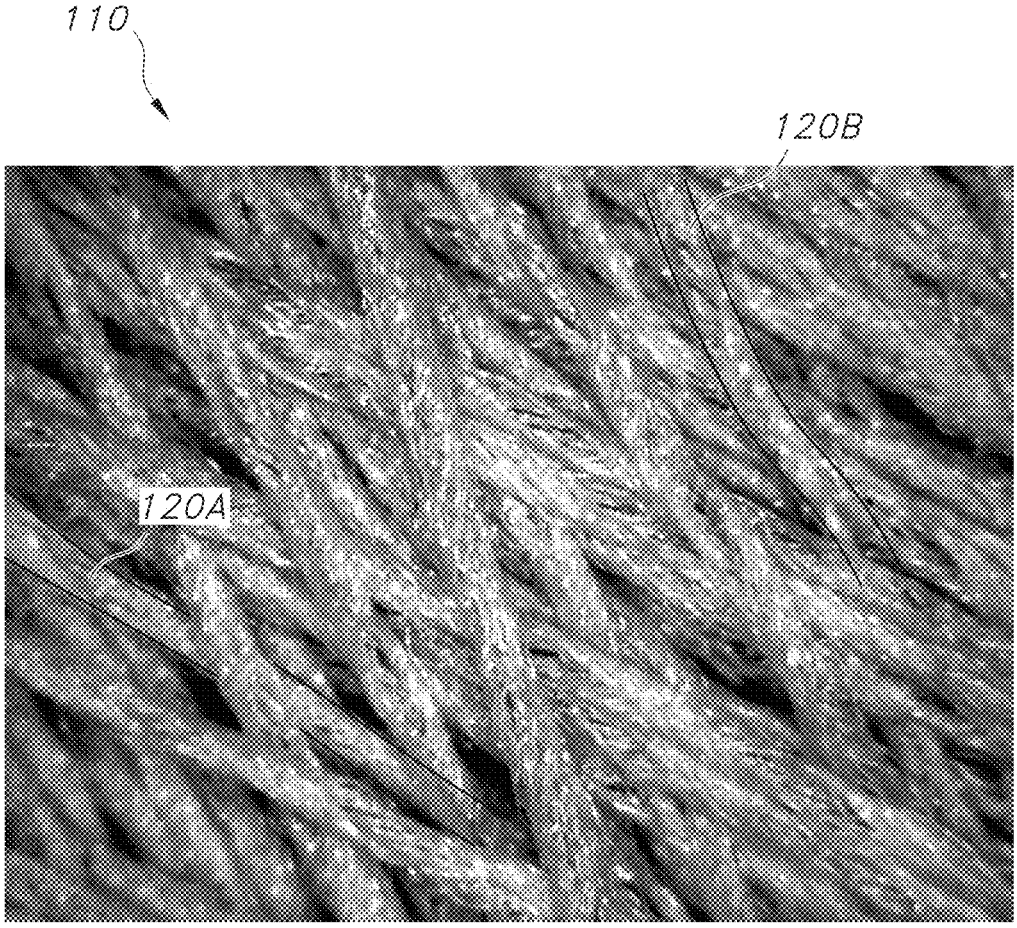
FIG. 4 is an image of a yarn made in accordance with the present disclosure.

FIG. 4 is an image of a zoomed-in view of a yarn 110 with a functional component, where the functional component is contained within a 0.102 mm monofilament core which is double covered with a 70 denier multifilament consisting of 34 filaments covering the monofilament core at 20 turns per inch, where the first cover layer 120A and second cover layer 120B are shown.

Figure 12A:
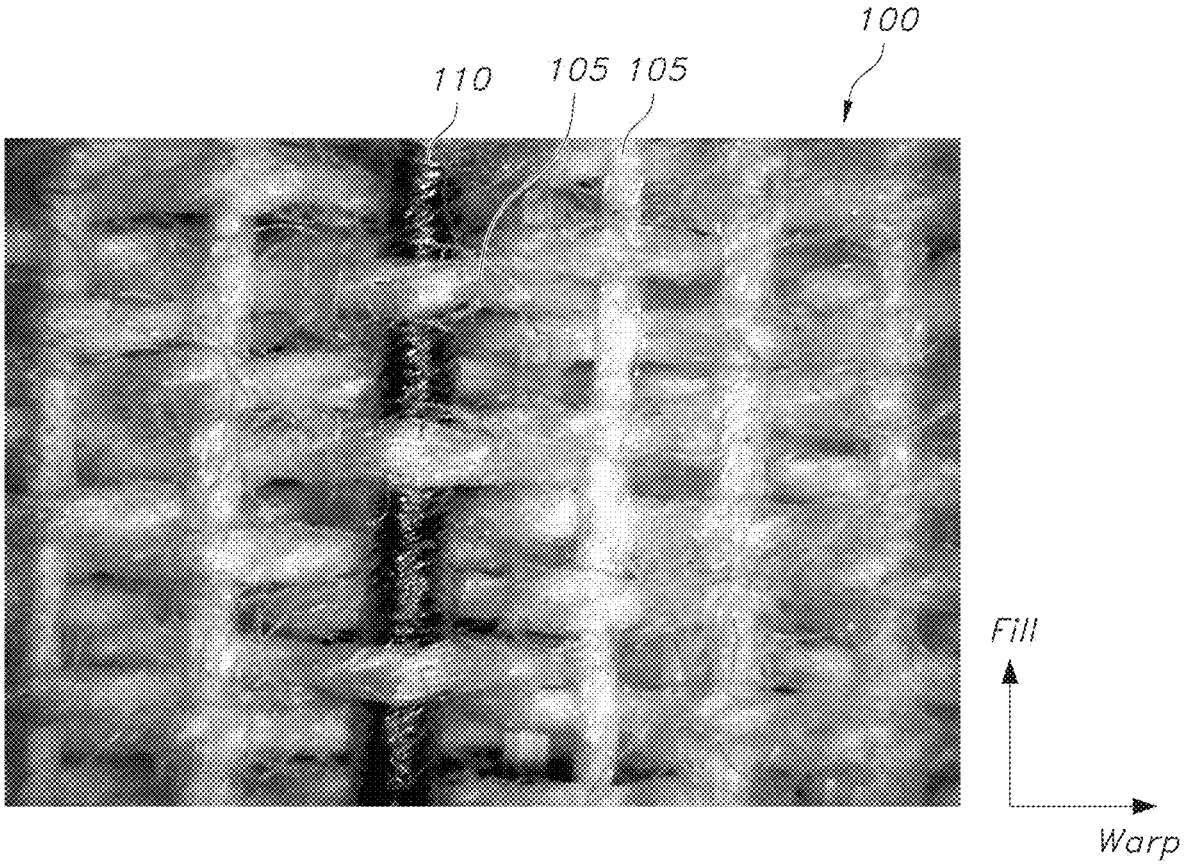
FIG. 12A is an image of a textile that includes a yarn made in accordance with the present disclosure.
Figure 12B:
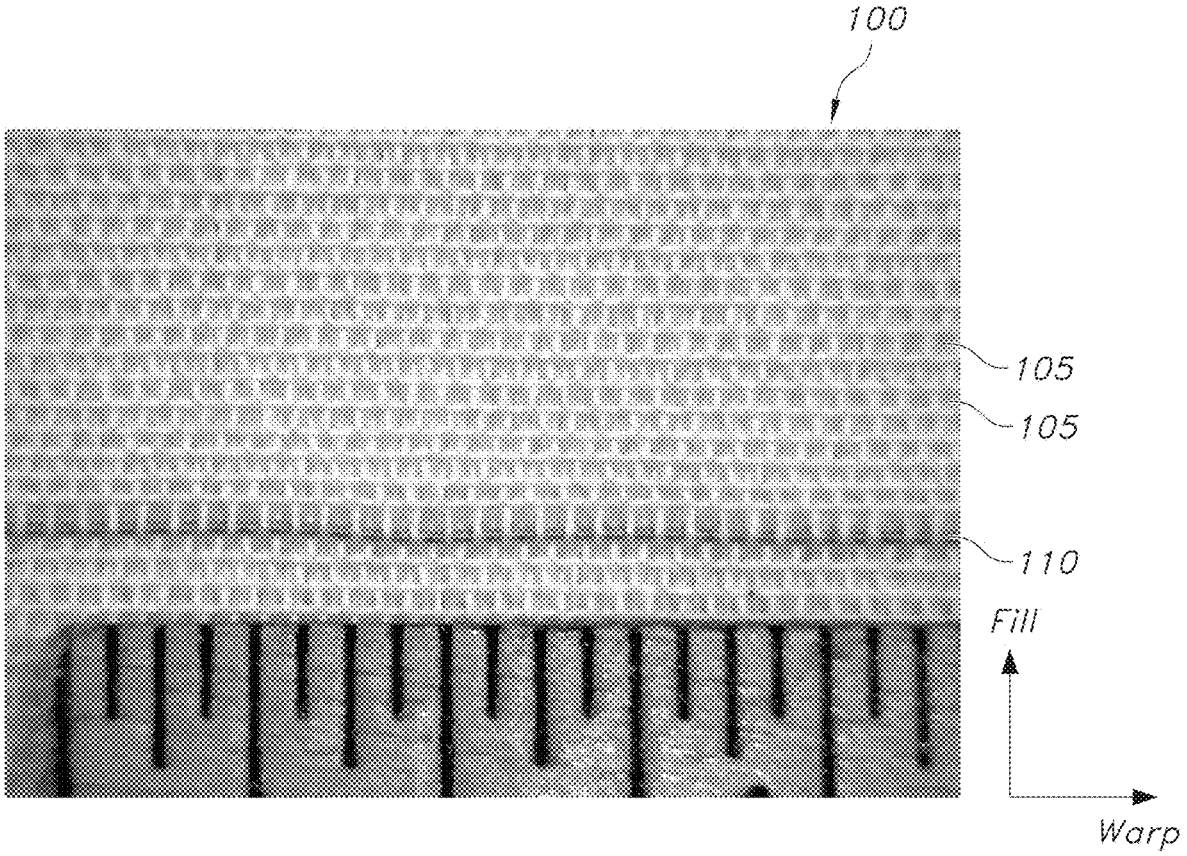
FIG. 12B is a zoomed-out view of the textile of FIG. 12A.

FIG. 12A is an image of a textile 100 that includes the yarn 110 with a functional component contemplated by the present invention that is woven in the fill direction along with a plurality of yarns 105 that do not include a functional component, where a plurality of yarns 105 that do not include a functional component are also present in the warp direction. Meanwhile, FIG. 12B is a zoomed-out view of the textile of FIG. 12A. Although FIGS. 12A and 12B show a 0.370 mm monofilament core double covered with a 70 denier monofilament that is woven into a textile with a weave construction that includes 100 ends per inch and 45 picks per inch in conjunction with the yarn 105 that does not include a functional component, it is to be understood that other weave constructions are also contemplated by the present invention.

These and other modifications and variations to the present invention may be practiced by those of ordinary skill in the art, without departing from the spirit and scope of the present invention, which is more particularly set forth in the claims. In addition, it should be understood that aspects of the various embodiments may be interchanged either in whole or in part. Furthermore, those of ordinary skill in the art will appreciate that the foregoing description is by way of example only, and is not intended to limit the invention so further described in such appended claims.

What is claimed is:

1. A yarn comprising:

a core, wherein the core comprises at least one filament having an active functional component embedded therein, and wherein the core has a diameter ranging from 0.075 mm to 0.5 mm; and a covering, wherein the covering is disposed on at least 50% of a total surface area of the core.

2. The yarn of claim 1, wherein the core further comprises a passive electronic component.

3. The yarn of claim 1, wherein the active functional component comprises a microprocessor, a computer, an electronic device, an integrated circuit, an LED, a GPS, a battery, a radio, or a combination thereof.

4. The yarn of claim 1, wherein the core comprises a monofilament yarn.

5. The yarn of claim 1, wherein the core comprises a multifilament yarn.

6. The yarn of claim 1, wherein the covering comprises a staple fiber, a continuous monofilament yarn, a continuous multifilament yarn, or a combination thereof.

7. The yarn of claim 1, further comprising an insulation disposed between the core and covering.

8. The yarn of claim 7, wherein the insulation comprises electrical or thermal insulation and is impermeable to water.

9. The yarn of claim 1, wherein the core is single covered with a continuous monofilament yarn or a continuous multifilament yarn.

10. The yarn of claim 8 or 9, wherein the covering has a thread count ranging from about 5 thread wraps per inch to about 100 thread wraps per inch.

11. The yarn of claim 1, wherein the core is double covered with two continuous filament or spun yarns.

12. The yarn of claim 1, wherein the covering has a linear mass density ranging from about 20 denier to about 150 denier.

13. A method of forming a yarn, wherein the yarn comprises a core having at least one filament having an active functional component embedded therein, wherein the core has a diameter ranging from 0.075 mm to 0.5 mm, the method comprising:

placing the core in a spinning process machine; and disposing a covering on the core, wherein the covering is disposed on at least 50% of a total surface area of the core.

14. The method of claim 13, wherein the covering comprises a staple fiber, a continuous monofilament yarn, a continuous multifilament yarn, or a combination thereof.

15. The method of claim 13, wherein the core is single covered with a continuous yarn.

16. The method of claim 13, wherein the core is double covered with two continuous filament or spun yarns.

17. The method of claim 13, wherein the core is covered by a ring spinning process, an open end spinning process, an air jet spinning process, an air-vortex spinning process, a friction spinning process, a compact spinning process, a covering process, or a combination thereof.

18. The method of claim 13, wherein the active functional component comprises a microprocessor, a computer, an electronic device, an integrated circuit, an LED, a GPS, a battery, a radio, or a combination thereof.

* * * * *